United States Patent [19]

Bhalla

[11] 4,230,964

[45] * Oct. 28, 1980

[54] COLOR HIGH-PRESSURE SODIUM VAPOR LAMP

[75] Inventor: Ranbir S. Bhalla, West Paterson, N.J.

[73] Assignee: Westinghouse Electric Corp., Pittsburgh, Pa.

[ * ] Notice: The portion of the term of this patent subsequent to Jul. 25, 1995, has been disclaimed.

[21] Appl. No.: 923,597

[22] Filed: Jul. 11, 1978

[51] Int. Cl.[3] ..... H01J 61/36

[52] U.S. Cl. ..... 313/220; 313/221

[58] Field of Search ..... 313/220; 428/450 (U.S. only)

[56] References Cited

U.S. PATENT DOCUMENTS

| | | | |
|---|---|---|---|
| 3,037,883 | 6/1962 | Wachtell et al. | 428/450 X |
| 3,293,068 | 12/1966 | Bradley et al. | 428/450 X |
| 3,492,102 | 1/1970 | Bornstein et al. | 428/450 X |
| 3,540,920 | 11/1970 | Wakefield | 428/450 X |
| 3,723,784 | 3/1973 | Sules et al. | 313/219 X |
| 3,906,272 | 9/1975 | Collins et al. | 313/220 X |
| 3,974,410 | 8/1976 | Collins et al. | 313/42 |
| 4,001,634 | 1/1977 | Corbley et al. | 315/73 |
| 4,052,636 | 10/1977 | Strok | 313/220 |
| 4,103,200 | 7/1978 | Bhalla | 313/221 |

OTHER PUBLICATIONS

Denbigh, "Effect of sodium/mercury ratio and amalgam temperature on the efficacy of 400 W high-pressure sodium lamps;" Lighting Research and Technology; vol. 6, #2, 1974; pp. 62–68.

Mizuno et al, "New High-Pressure Sodium Lamp with Higher Color Rendition;" CIE XVII Session, Barcelone 1971, P-71.14.

Hanneman et al, "Thermodynamic and Experimental Studies of the High-Pressure Sodium Lamp;" Illuminating Engineering; Mar. 1969; pp. 162–166.

Rickman, "High-pressure sodium lamp arc tube temperature and alumina sublimation;" Journal of Applied Physics; vol. 48, #9; Sep., 1977; pp. 3733–3738.

Ozaki, "Luminous Efficiency of the High-Pressure Sodium Lamp;" Journal of Applied Physics; vol. 42, #8; Jul., 1971; pp. 3171–3175.

*Primary Examiner*—Robert Segal

*Attorney, Agent, or Firm*—B. R. Studebaker

[57] ABSTRACT

A high-pressure sodium vapor discharge lamp of improved color including in combination a specified arc length to power input, a predetermined sodium to mercury amalgam ratio, heat shields surrounding each end of the arc tube and an improved end cap to arc tube seal, which combine to increase the sodium vapor pressure and provide a lamp of greatly improved color.

6 Claims, 4 Drawing Figures

COLOR HIGH-PRESSURE SODIUM VAPOR LAMP

CROSS-REFERENCE TO RELATED APPLICATION

This application relates to copending application Ser. No. 796,579 filed May 13, 1977 for Arc Tube End Seal And Method Of Forming, now issued as U.S. Pat. No. 4,103,200 filed by the present applicant and owned by the same assignee. The said copending application relates to a method of precoating the refractory metal end cap with a slurry of metallic silicon to accomplish improved bonding between the end cap and the arc tube and the resulting article.

BACKGROUND OF THE INVENTION

The high-pressure sodium lamp has been commercially available for many years. Because of the color rendering properties of the standard sodium vapor lamp, their use has been generally restricted to roadway, industrial and similar floodlighting applications where color rendition is not of particular importance. Because of the high-pressure sodium lamp's relatively poor color rendering properties it has not found its way into commercial, school, retail or other color-sensitive applications. These commercially available high-pressure sodium discharge lamps have a color rendering index (CRI) of generally between 15 and 25, but perform with an efficacy of between 100 and 110 lumens per watt.

In designing lamps for optimum efficiency it has been necessary to maintain the sodium pressure on the order of about 100 torr at the operating temperature and the reversal of the sodium D line should be within a fairly wide range of between about 4 nm and 10 nm depending upon the amalgam ratio. The relationship between the efficiency and the sodium D line reversal is a well-know phenomenon. It is also well known that the CRI of the high-pressure sodium lamp improves as the sodium pressure in the lamp increases, as was pointed out in the paper "New High-Pressure Sodium Lamp With Higher Color Rendition" by H. Mizuno, et al. CIE XVII Session, Barcelone 1971. For example, if the currently marketed lamps are overloaded to run at higher wattages, the color rendering properties of the lamp are significantly improved. This improvement is achieved at considerable expense of a shortened lamp life.

It has also been known that increasing the sodium vapor pressure by means of increased temperatures will improve the lamp color, but operating these lamps at the temperatures required have presented problems with seal failure and results in extremely short lamp life. It has also been known for many years and disclosed in U.S. Pat. Nos. 3,723,784; 3,974,410 and 4,001,634 to employ metal bands or shields about the ends of the arc tube in order to increase the temperature in the area of the coldest part of the arc tube.

Producing a high-pressure sodium vapor discharge lamp with a CRI value of between 65 and 75 without a significant loss in lamp efficacy would provide a source of illumination which is both energy-efficient, has a reasonably long life and would be suitable for applications such as schools, offices and retail operations where proper color rendition is of sigificant importance.

SUMMARY OF THE INVENTION

This invention relates to high-pressure sodium discharge lamps and more particularly to a high-pressure sodium discharge lamp having significantly improved color rendering properties.

The high-pressure sodium vapor discharge lamp of improved color is provided by employing an outer envelope sealed to a standard base and an arc tube having a tubular polycrystalline alumina or sapphire body mounted within the outer envelope by a mounting frame electrically connected to the base, which lamp, further comprises a refractory metal end cap sealed to each end of the arc tube body with each of said end caps including a silicon coating on the interior surfaces thereof and discharge sustaining electrodes mounted to each of the end caps with the ends of the electrodes spaced a predetermined distance from each other. A discharge sustaining fill is provided within the arc tube body which principally comprises a sodium-mercury amalgam of predetermined proportions. Cylindrical heat shields are mounted to the mounting frame and surround the end caps and a portion of each end of the arc tube body to thereby maintain a sufficient temperature at the arc tube cold spot to provide good color rendering properties with only a slight loss in lamp efficiency.

The predetermined sodium-mercury amalgam is from about 21 to 25 weight percent sodium and the end caps are sealed to the arc tube body by a glassy sealing frit principally comprising alumina and calcia which is interposed between the arc tube body and the silicon coating on the interior surface of the end caps.

BRIEF DESCRIPTION OF THE DRAWING

Many of the attendant advantages of the present invention will become more readily apparent and better understood as the following detailed description is considered in connection with the accompanying drawing in which.

DESCRIPTION OF THE PREFERRED EMBODIMENT

Figure 1:
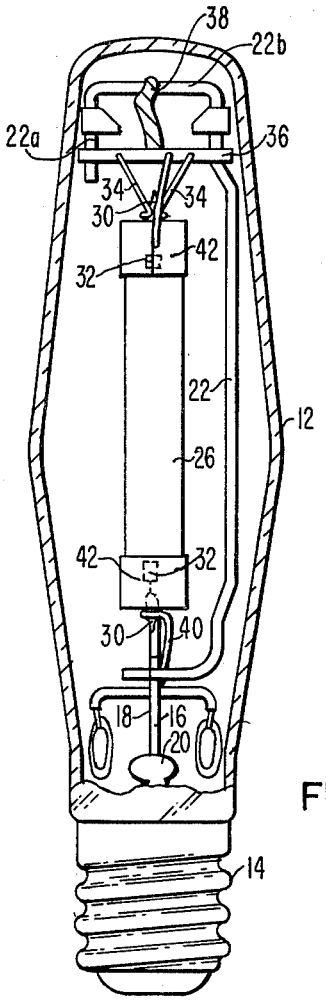
FIG. 1 is a front-elevational view, partly in section, of a high-pressure sodium discharge lamp constructed in accordance with this invention.
Figure 2:
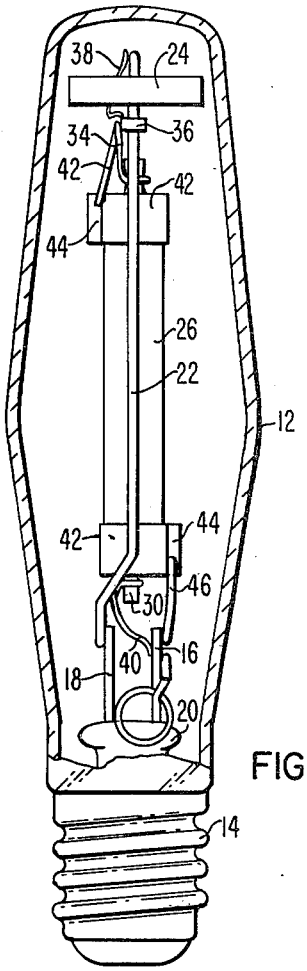
FIG. 2 is a side-elevational view, partly in section, of the lamp of FIG. 1.
Figure 4:
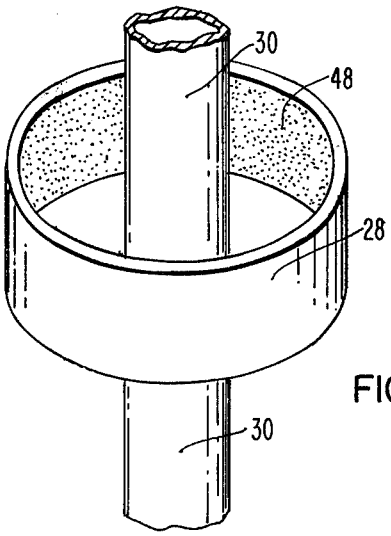
FIG. 4 is a schematic illustration of the end cap and electrode supporting exhaust tubulation of this invention.
Figure 3:
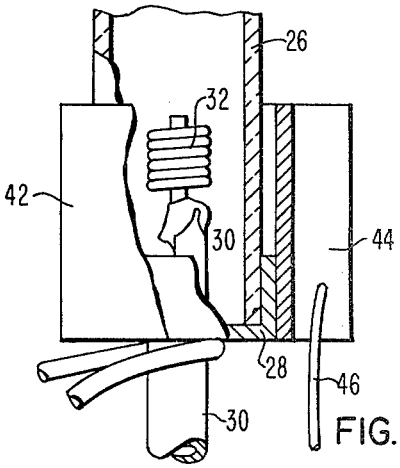
FIG. 3 is a side-elevational view, partly in section, of one end of the arc tube illustrated in FIG. 2.

Referring now in detail to the drawing wherein like reference characters represent like parts throughout the several views, there is illustrated in FIG. 1 a typical high-pressure sodium vapor discharge lamp modified in accordance with this invention. The high-pressure sodium vapor discharge lamp includes an outer envelope 12 sealed to a standard mogul base 14. A pair of lead-in conductors 16 and 18 are conventionally connected to the mogul base 14 and extend through a reentrant stem press 20 at the base of the envelope 12 in a conventional manner. Mounted on the upper end of lead-in conductor 18 is an arc tube support frame 22 which serves to both retain and mount the arc tube within the outer envelope as well as to conduct electricity to the upper electrode of the arc tube. The arc tube frame 22 is supported on its upper end within the envelope 12 by a pair of resilient spring members 24 which serve to retain the frame 22 in a central location within the outer envelope 12 through resilient contact with the inner surface of the outer envelope.

The ceramic arc tube includes a tubular ceramic body of polycrystalline alumina or sapphire 26 closed off at each end by a pair of electrode carrying refractory metal end closure members or end caps 28. The end caps 28 have extending therethrough refractory metal tubulations 30 which carry brazed to their interior ends discharge sustaining electrodes 32. At the upper end of the lamp, the end remote from the base, the tubulation 30 is electrically connected by means of leads 34 to the support strap 36 which is slidably retained on the legs 22 and **22*a* of the support frame 22 to accommodate for expansion of the arc tube during operation of the lamp. Electrical potential is supplied to the upper electrode 32 through the leads 34 and the slidable support strap 36 by a braided lead-in conductor 38 which is attached centrally to the upper horizontal leg 22*b* of the support frame 22 and connects to the support strap 36. At the lower end of the arc tube the tubulation 30 is directly connected to the lead-in conductor 16 through lead wire 40**.

Metallic heat shields 42 surround each end of the arc tube and associated end cap and include a tap portion 44 which is connected to the support strap 36 at the upper end of the lamp and to lead-in conductor 16 at the lower end of the lamp by means of rigid supports 46.

It is well known that to improve the color rendering index (CRI) of a high-pressure sodium discharge lamp it is necessary to increase the sodium vapor pressure to provide for sodium "D" line reversal. It has also been known that the logical way to accomplish this sodium "D" line reversal is to raise the temperature of the cold spot in the lamp. In prior art sodium discharge lamps, efforts to increase the sodium vapor pressure through increased temperature have resulted in extremely short lamp life because of seal breakdown between the arc tube body and the refractory metal end cap. In accordance with the present invention, by closely controlling the operating parameters of a high-pressure sodium discharge lamp, lamps have been produced having a CRI in excess of 65 which provide good color rendition to illuminated objects. These lamps operate at 100 volts and have been successful for lamps of 150, 200, 250 and 400 watts operating on a standard sodium discharge lamp ballast.

In accordance with the present invention lamps having an arc tube 26 of polycrystalline alumina with niobium end caps 28 and niobium tubulation 30 employ a discharge sustaining sodium-mercury amalgam in the discharge which is from between about 21 weight percent to 25 weight percent sodium with the preferable loading being an amalgam containing 25 weight percent sodium. In addition to the sodium-mercury amalgam, 20 torr of xenon gas is used in the arc tube fill. The heat conserving shields 42 are preferably of nickel and in the 150-watt version are about 12.5 millimeters in width with a 10 millimeter diameter. The use of heat conserving shields to increase the cold spot temperature are well known in the art and are disclosed in U.S. Pat. Nos. 3,723,784; 3,974,410 and 4,001,634.

One problem in increasing the sodium pressure through increase of the cold spot temperature is that for a given amalgam ratio and arc tube diameter, as the cold spot temperature increases both the sodium and mercury vapor pressures increase resulting in increased lamp voltage. To compensate for the lamp voltage increase the arc length must be shortened. In order to provide lamps that will operate with standard high-pressure sodium ballasts the lamp voltage must be kept at 100 volts. One method for controlling voltage is to decrease the arc length, the distance between the tips of the two spaced electrodes 32. As the arc length is shortened the lamp wall loading increases resulting in an increased arc tube wall temperature which can result in undesirable evaporation of alumina from the arc tube. The wall temperature, the hottest spot on the wall, should not exceed 1200° C. In order to prevent the hottest spot on the wall from exceeding 1200° C. it has been found that the lamp wall loading should not exceed 22 watts/cm$^2$. This problem can be obviated by providing in a 250-watt lamp with a sodium-mercury amalgam of 25 weight percent sodium and an internal arc tube diameter of 8.0 millimeters, an arc length of 52 millimeters. The 200-watt lamp with the same amalgam ratio and an internal arc tube diameter of 7.15 millimeters should have an arc length of 48 millimeters, and a 150-watt lamp with an arc tube having an internal diameter of 5.4 millimeters, a 38 millimeter arc length should be maintained.

Many of the foregoing lamp parameters as they relate to a high-pressure sodium discharge lamp were either well known or within the purview, experimentally, of those skilled in the art. However, an operable high-pressure sodium discharge lamp constructed in accordance with the foregoing parameters would have an extremely short life and therefore not be a practical lamp embodiment. The previously referenced copending application Ser. No. 796,579 filed May 13, 1977 for Arc Tube End Seal And Method Of Forming, now issued as U.S. Pat. No. 4,103,200 discloses the coating of the inner surface 48 of the skirt portion of the end cap 28 with a silicon powder slurry. This coating is baked in a vacuum for about 20 minutes at 1400° C. before the end caps are placed on the ends of the arc tube body 26 and a sealing frit which principally comprises calcia and alumina, in about eutectic proportions, but which may also include small quantities of silica, magnesia or baria is applied to the intersection of the ends of the end cap 28 skirt portion and the side walls of the arc tube body about the whole circumference of the arc tube body and the assembly then placed in a furnace. This assembly is then heated in accordance with a conventional sealing schedule which causes the glassy sealing frit to flow by capillary action to all those areas of interface between the end cap 28 and the arc tube body 26. By employing this particular end cap to arc tube body seal, the lamps can be operated at a much higher cold spot temperature, a cold spot temperature at about 100° C. higher than conventional lamps, in order to provide the dramatic improvement in the color rendering properties of the sodium vapor discharge lamp.

As an illustration of the effectiveness of the improved bond between the niobium end cap and the sealing frit by use of the silicon metal coating, a pair of 150-watt lamps constructed in accordance with the foregoing description were operated side-by-side, one employing the silicon-coated cap and the other having no internal coating on the end cap prior to sealing. The average life of lamps without the silicon coating was only about 350 hours and in every case the failure was in a seal leak. By comparison, the lamp with the silicon-coated cap was still operating after 7,000 hours of testing and the lamp maintained its significantly improved CRI.

What is claimed is:

1. A high-pressure sodium vapor discharge lamp including an outer envelope sealed to a standard base and an arc tube having a tubular polycrystalline alumina or sapphire body mounted within said outer envelope by a mounting frame, which is electrically connected to said base, said discharge lamp further comprising:

a refractory metal end cap sealed to each end of the arc tube body, each of said end caps including a silicon coating on the interior surface thereof and a glassy sealing frit principally comprising alumina and calcia interposed between said silicon coating and said arc tube body, a discharge sustaining electrode mounted to each of said end caps, said discharge sustaining electrodes spaced a predetermined distance from each other, a discharge sustaining fill within said arc tube body, said discharge sustaining fill principally comprising a sodium-mercury amalgam of predetermined proportions; and cylindrical heat shields mounted to said mounting frame and surrounding said end caps and a portion of each end of said arc tube.

2. The high-pressure sodium vapor discharge lamp of claim 1 wherein said predetermined sodium-mercury amalgam is 21–25 weight percent sodium.

3. The high-pressure sodium vapor discharge lamp according to claims 1 or 2 wherein the predetermined distance between said electrodes is 52 millimeters and said arc tube has an internal diameter of 8.0 millimeters.

4. A high-pressure sodium vapor discharge lamp including an outer envelope sealed to a standard base and an arc tube having a tubular polycrystalline alumina or sapphire body mounted within said outer envelope by a mounting frame, said mounting frame being electrically connected to said base, said discharge lamp further comprising:

a pair of refractory metal end caps sealed to each end of said arc tube body, each of said end caps including a silicon coating on the interior surface thereof and a glassy sealing frit principally comprising alumina and calcia interposed between said silicon coating and said arc tube body, a discharge sustaining electrode mounted to each of said end caps and extending into said arc tube body with the ends of said discharge sustaining electrodes being spaced a predetermined distance from each other, a discharge sustaining fill within said arc tube body, said discharge sustaining fill principally comprising a sodium-mercury amalgam of predetermined proportion and xenon gas; and cylindrical heat shields mounted to said mounting frame and surrounding said end caps and a portion of each end of said arc tube body to thereby increase the cold spot temperature within said arc tube.

5. A high-pressure sodium vapor discharge lamp according to claim 4 wherein said predetermined sodium-mercury amalgam is 25 percent sodium by weight and said xenon gas is at a pressure of 20 torr.

6. The high-pressure sodium vapor discharge lamp according to claim 5 wherein the predetermined distance between said electrodes is 52 millimeters and said arc tube has an internal diameter of 8.0 millimeters.

* * * * *